United States Patent [19]

Mulcahy

[11] Patent Number: 4,901,715

[45] Date of Patent: Feb. 20, 1990

[54] APPARATUS AND METHOD FOR BREATHING THROUGH THE SOIL-STACK DURING A HIGH-RISE FIRE

[76] Inventor: Timothy E. Mulcahy, 2650 W. 85th St., Chicago, Ill. 60652

[21] Appl. No.: 208,967

[22] Filed: Jun. 20, 1988

[51] Int. Cl.[4] ..... A62B 7/10; A62B 7/00

[52] U.S. Cl. ..... 128/200.24; 128/204.18; 128/205.13; 4/218; 4/209 R

[58] Field of Search ..... 128/201.11, 201.27, 128/207.12, 200.24, 201.23, 201.24, 205.25, 204.18, 206.21, 202.13, 205.29, 205.27, 205.28, 206.28, 206.12, 205.18, 205.13, 205.15, 205.16; 4/218, 209 R, 216

[56] References Cited

U.S. PATENT DOCUMENTS

| | | | |
|---|---|---|---|
| 667,840 | 2/1901 | Guthrie | 128/202.13 |
| 958,427 | 5/1910 | Panian | 128/202.13 |
| 3,216,413 | 11/1965 | Mota | 128/205.13 |
| 4,187,845 | 2/1980 | Dror | 128/205.13 |
| 4,320,756 | 3/1982 | Holmes | 128/200.24 |
| 4,331,139 | 5/1982 | Popa | 128/206.28 |
| 4,373,522 | 2/1983 | Zien | 128/200.24 |
| 4,440,164 | 4/1984 | Werjefelt | 128/202.13 |
| 4,467,796 | 8/1984 | Beagley | 128/200.24 |
| 4,539,985 | 9/1985 | Magrath | 128/205.13 |
| 4,608,975 | 9/1986 | Tannatta | 128/206.28 |

FOREIGN PATENT DOCUMENTS

| | | | |
|---|---|---|---|
| 2121950 | 6/1982 | United Kingdom | 128/205.13 |

*Primary Examiner*—Edgar S. Burr
*Assistant Examiner*—Kimberly L. Asher
*Attorney, Agent, or Firm*—Mason, Kolehmainen, Rathburn & Wyss

[57] ABSTRACT

Apparatus for establishing gaseous communication between a room of a building, wherein said room contains a toilet bowl, and a building conduit disposed within the building, said building conduit being in gaseous communication with the atmospheric gases outside of the building comprising: a toilet bowl having a water level forming a water trap, said toilet bowl including a flexible, water-impermeable, tubular member inserted completely through the water trap so that a first end of the flexible tubular member is disposed on a building conduit side of the water trap and a second end of the flexible tubular member is disposed on a room side of the water trap.

16 Claims, 4 Drawing Sheets

10
12
14
16
18
20
22
24
26
28
30
32
40
42
44
46
60
62
64
66
68
70
72
74
76
78
86
88
90
140
144
148
56

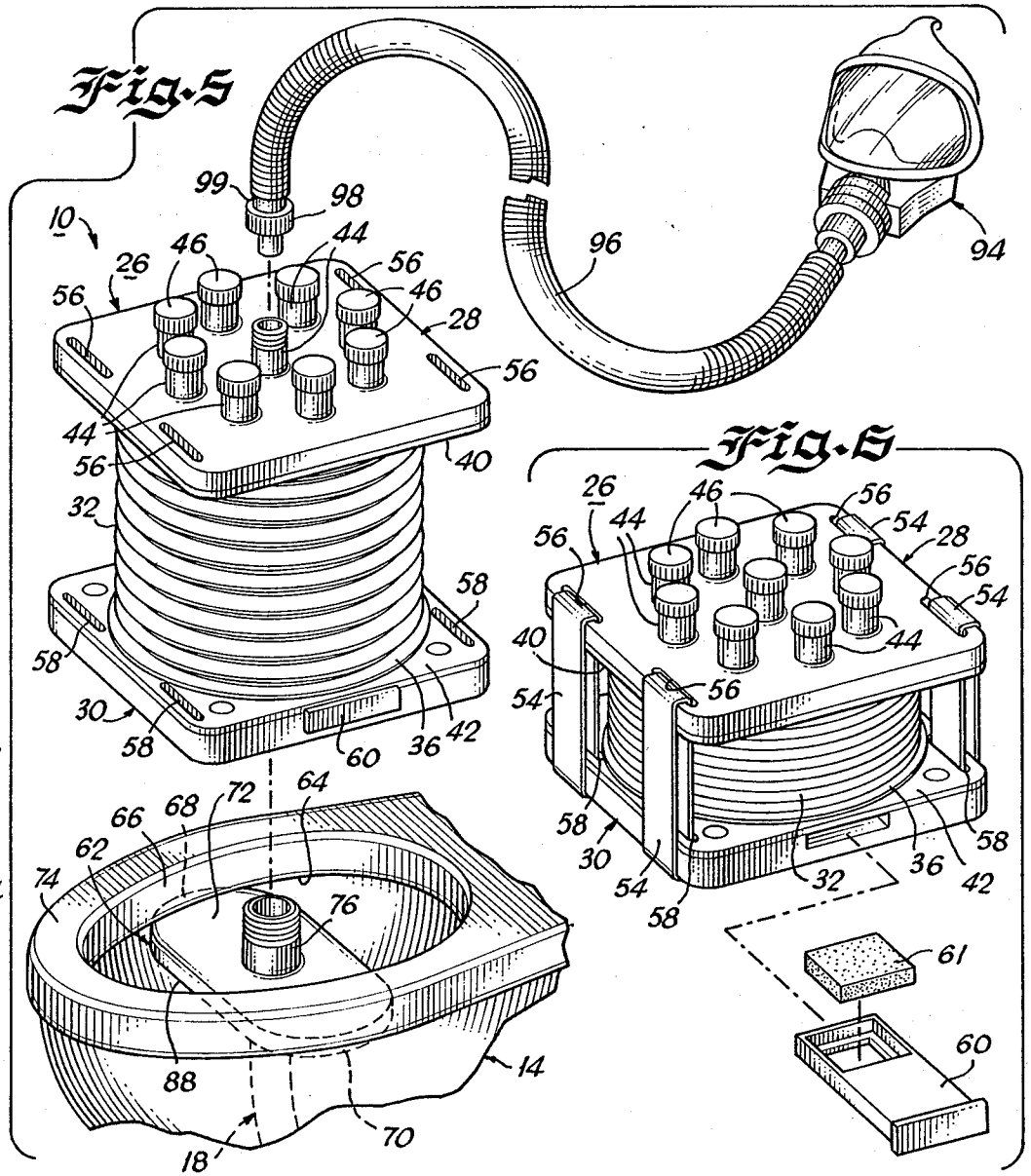
FIG. 5
FIG. 6
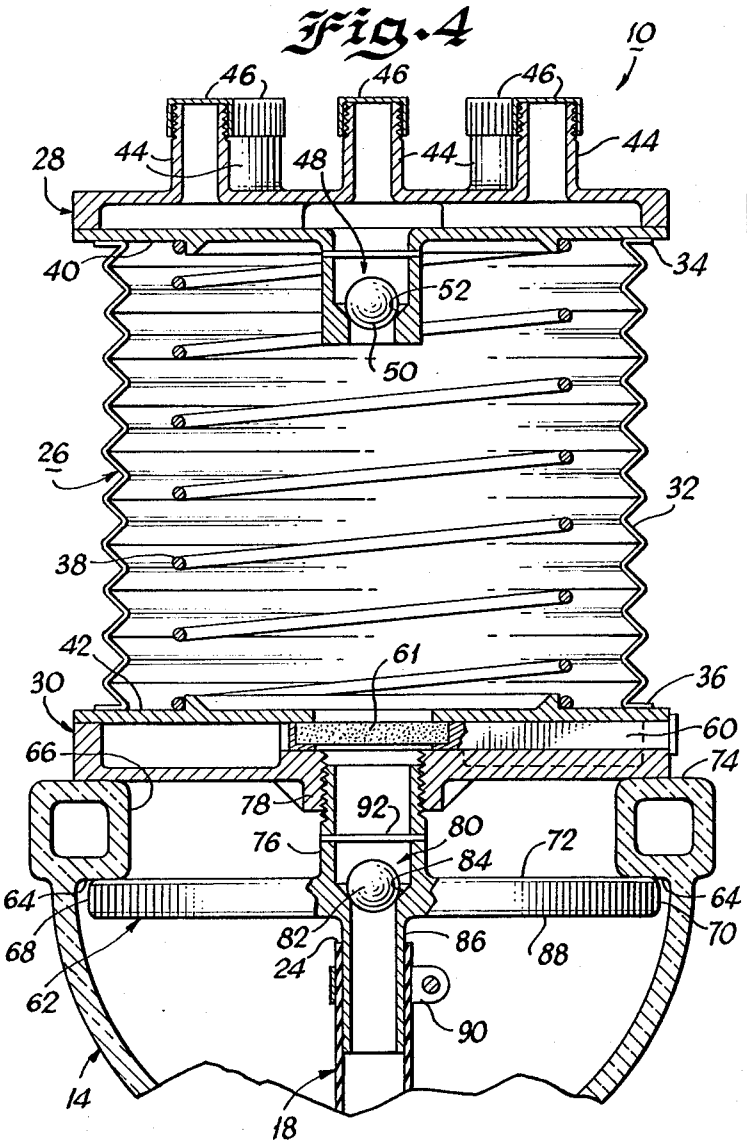
FIG. 4

Fig. 7
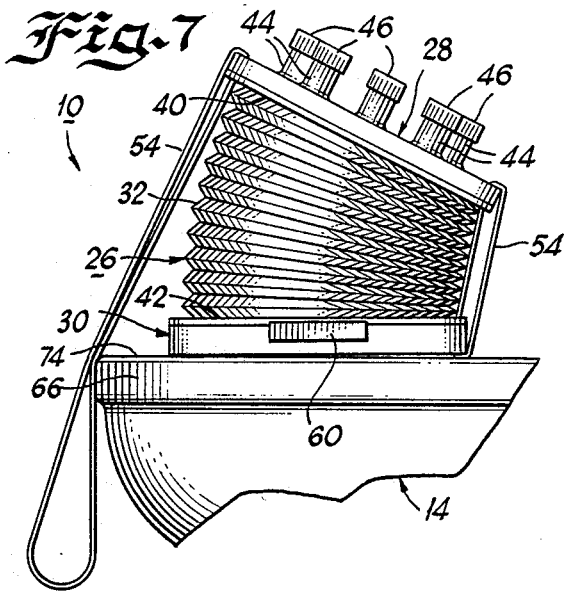
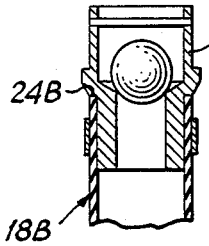
Fig. 10
Fig. 8
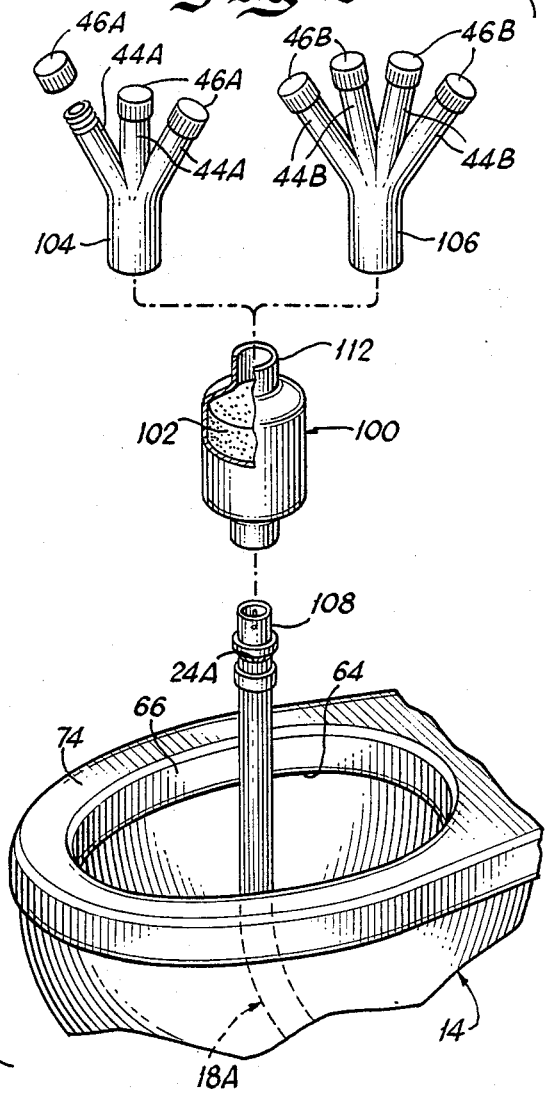
Fig. 9
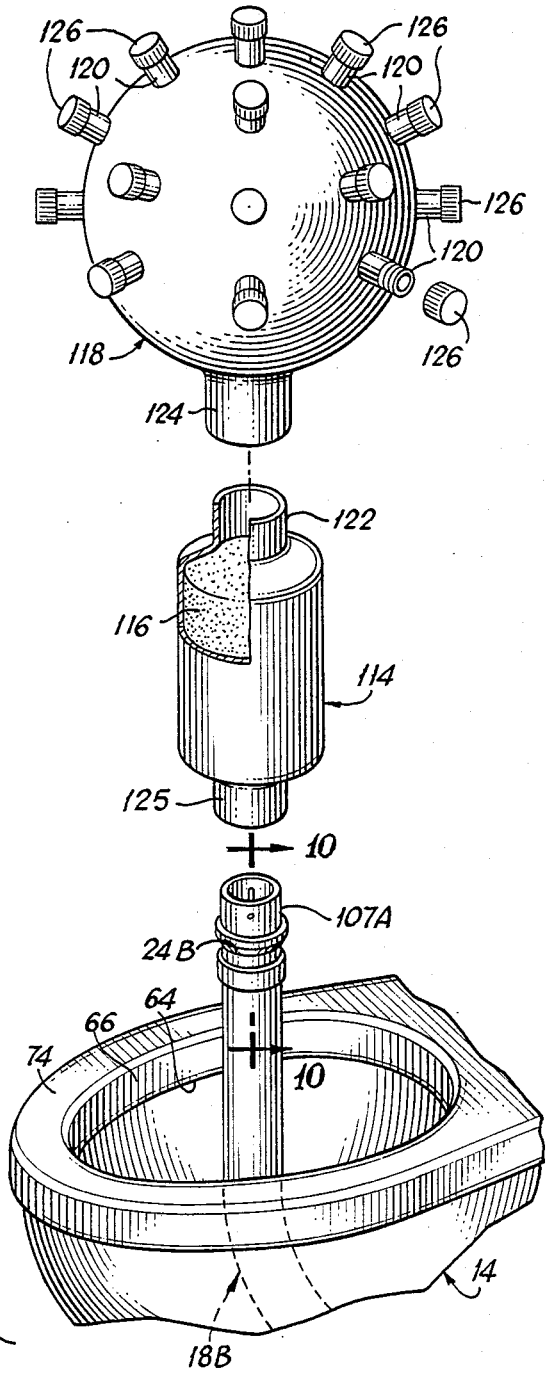

Fig. 11
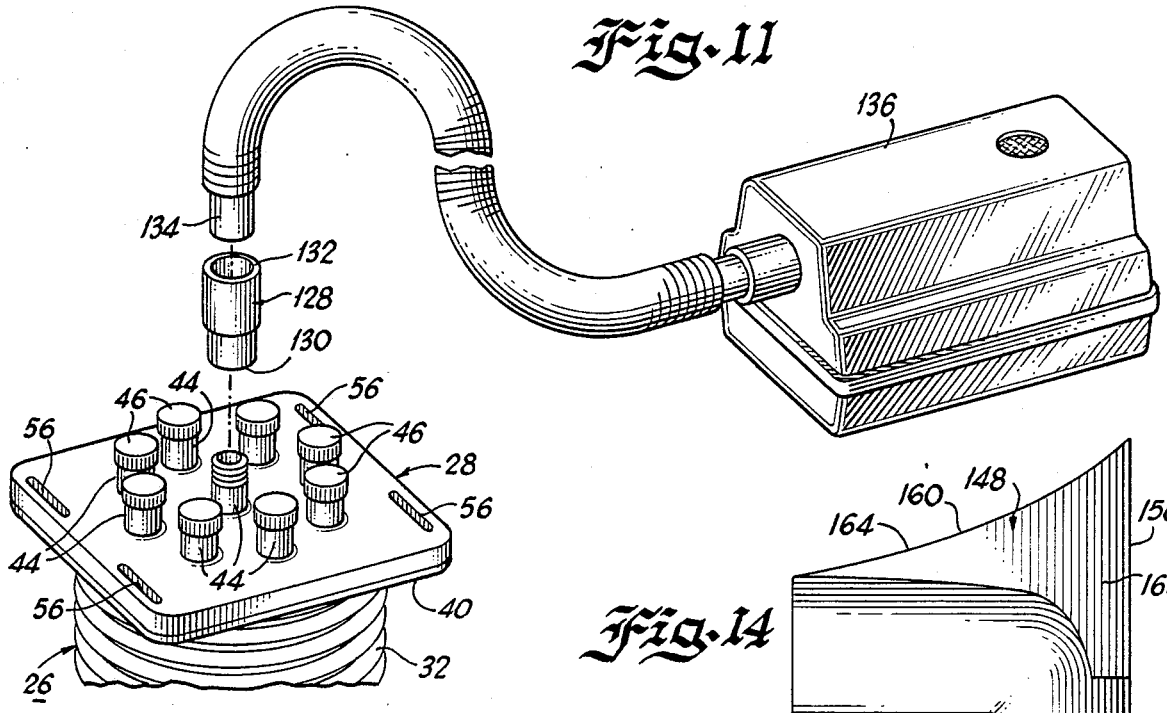
Fig. 14
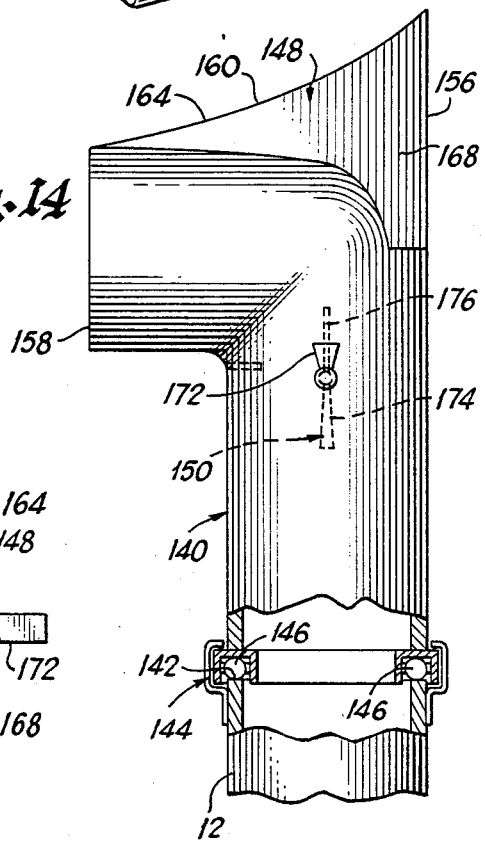
Fig. 12
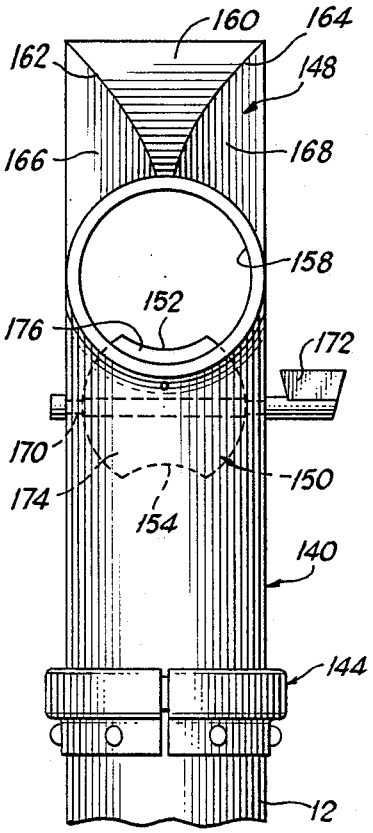
Fig. 13
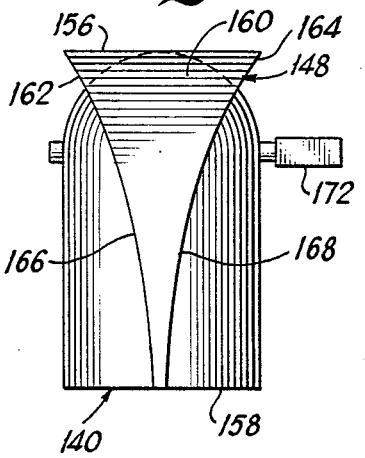
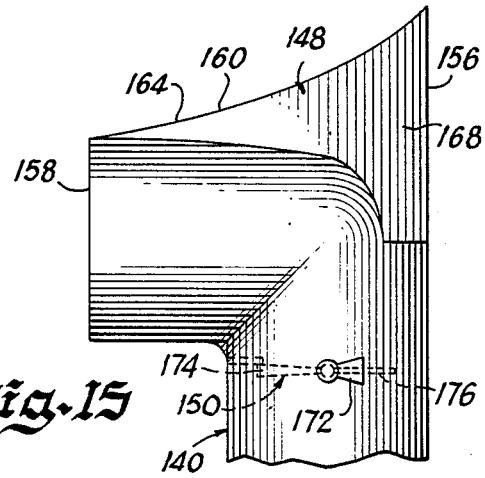
Fig. 15

APPARATUS AND METHOD FOR BREATHING THROUGH THE SOIL-STACK DURING A HIGH-RISE FIRE

FIELD OF THE INVENTION

The present invention is directed to an apparatus and method for breathing through the soil-stack of a high-rise building to prevent smoke inhalation—the cause of most deaths that occur during a high-rise fire. More particularly, the present invention is directed to an apparatus and method including a flexible tube or conduit adapted to be inserted through a toilet bowl to gain access to the air within a soil-stack and to cause the flow of the soil-stack air to enter a bathroom to prevent injury and death due to smoke inhalation.

BACKGROUND OF THE INVENTION AND PRIOR ART

The most emminent danger from a fire in a multi-story building is lack of suitable air for breathing when one is trapped in the building and cannot escape before rescue. While some serious injuries or deaths result from heat injury, most serious injuries and deaths resulting from a multi-story building fire are from smoke inhalation, consequent lung damage, and insufficient life-sustaining oxygen due to being trapped in an area of the building that does not contain suitable air for breathing.

Tannatta U.S. Pat. No. 4,608,975 discloses apparatus capable of being attached to a sink pipe, downstream of a water trap in the sink, to gain access to the building plumbing system vent lines. A serious drawback of this apparatus is that the sink pipe, downstream of the water trap, must be structurally modified in order to attach the apparatus for access to the plumbing vent lines. Another drawback to the device of the Tannatta patent is that it is not capable of pumping the plumbing vent line gases to the user of the device to insure an adequate supply of suitable oxygen to the user, but relies upon the lungs of the user to cause a flow of plumbing vent line gas to the user's lungs. These and other disadvantages are overcome in accordance with the apparatus and method of the present invention.

BRIEF DESCRIPTION OF THE DRAWINGS

FIG. 4 is an enlarged, partially elevated, partially broken-away cross-sectional view taken along the line 4—4 of FIG. 3;

FIG. 5 is a partially broken-away, exploded perspective view of the apparatus of the present invention shown with a breathing mask adaptation;

FIG. 6 is an exploded perspective view of a bellows portion of the apparatus of the present invention showing the bellows in a compressed, storage position;

FIG. 7 is a partially broken-away perspective view of the bellows portion of the apparatus of the present invention showing the bellows in an operative, partially released position for manual pumping;

FIG. 8 is a partially broken-away, exploded perspective view of a more portable embodiment of the apparatus of the present invention;

FIG. 9 is another partially broken-away, exploded perspective view of another embodiment of the apparatus of the present invention;

FIG. 10 is a partially broken-away, partially elevated, cross-sectional view of a check valve portion of the apparatus of FIG. 9 taken along the line 10—10 of FIG. 9;

FIG. 11 is a partially broken away, exploded perspective view of the apparatus of FIGS. 1–7 showing the apparatus adapted for operative connection to a vacuum cleaner or other blower apparatus for electrical pumping of soil-stack air;

FIG. 12 is a partially broken-away elevational view of an elbow stack device extending from the exterior of a high-rise building adapted to receive fresh air and transmit the fresh air through the soil-stack to the breathing apparatus of the present invention and showing an interior baffle in a fully open position;

FIG. 13 is a perspective rear view of a wind tetrahedron portion of the elbow stack device of FIG. 12;

FIG. 14 is a partially broken-away, side perspective view of the elbow stack device of FIG. 12 showing the interior baffle in an open position, and showing rotating bearings for rotation of the elbow stack device into the atmospheric wind; and FIG. 15 is a partially broken-away, side elevational view of the elbow stack device of FIGS. 12–14, showing the interior baffle in a closed position.

DETAILED DESCRIPTION OF THE PREFERRED EMBODIMENTS

Figures 1, 2, 3:
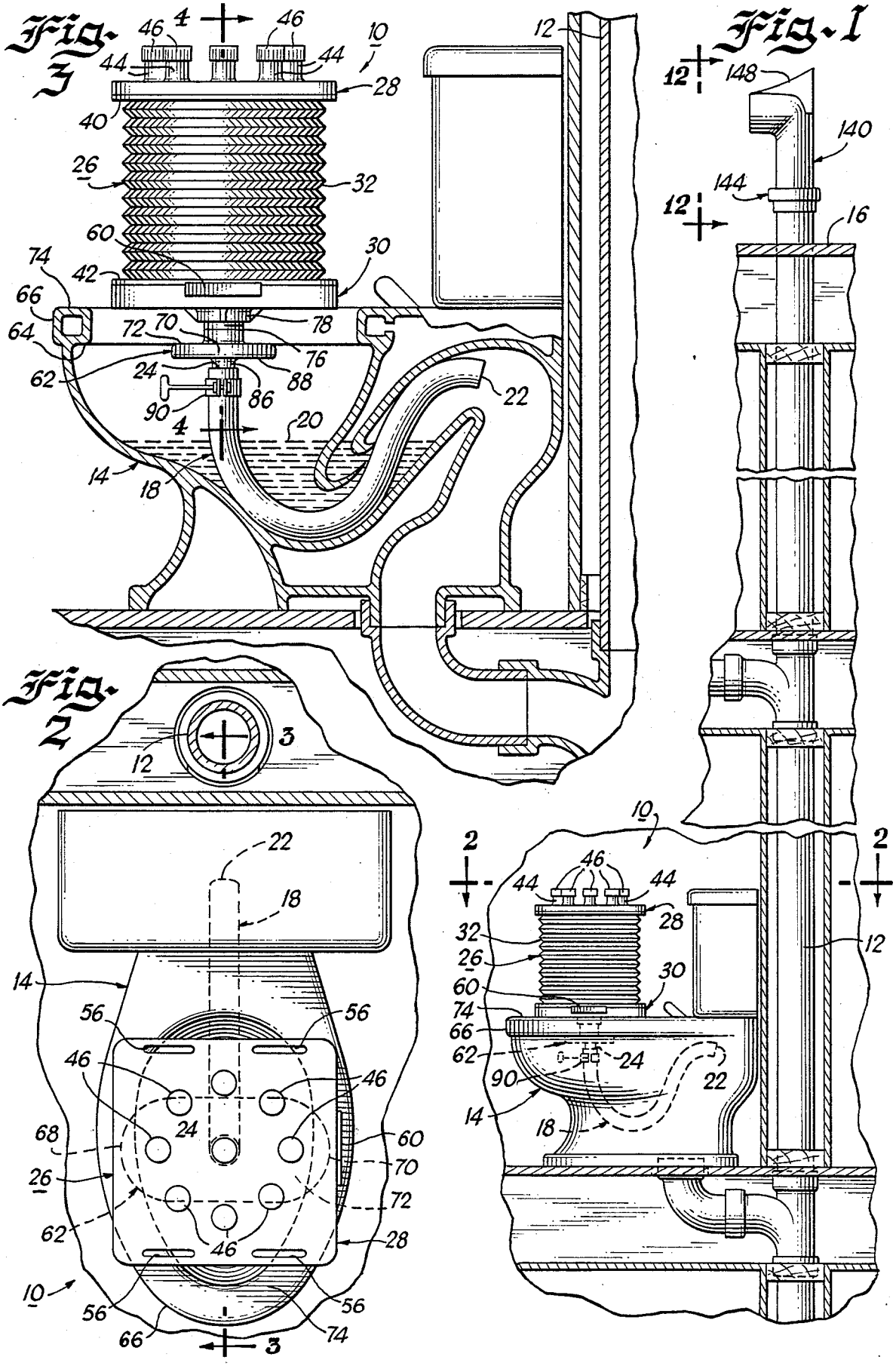
FIG. 1 is a partially elevated, broken-away perspective view of one embodiment of the apparatus of the present invention showing the apparatus in operative disposition connected through a toilet bowl water trap to a soil-stack air source in a high-rise building.
FIG. 2 is a partially elevated, broken-away view of the apparatus of the present invention taken along the line 2—2 of FIG.1.
FIG. 3 is a partially elevated, partially broken-away side view of the apparatus of the present invention taken along the line 3—3 of FIG. 2.

Turning now to the drawings, and initially to FIG. 1, there is illustrated a new and improved apparatus, generally designated 10, for accessing air from a soil-stack, generally designated 12, through a toilet bowl, generally designated 14, to the respiratory system of a user, such as in the case of a high-rise fire to minimize or prevent smoke inhalation. As well known in the art, multi-story buildings, particularly high-rise buildings, include one or more soil-stacks 12 in fluid communication with the atmosphere at the exterior of the building and vented at the roof 16 of the building. Because the soil-stack 12 is in fluid communication with the atmosphere, the soil-stack 12 contains a continuous supply of life-sustaining oxygen accessible through each toilet bowl 14 operatively connected to the soil-stack 12 within the building. In accordance with an important feature of the present invention, an apparatus and method are provided so that a person in proximity to a toilet bowl 14 or within the same room that the toilet bowl 14 is operatively connected to the soil-stack 12, can gain access to the oxygen within the soil-stack 12 for survival until the fire, smoke, toxic fumes, or other life-threatening atmospheric condition within the building is obviated.

As best shown in FIG. 3, the apparatus of the present invention includes a flexible, soil-stack access tube or conduit, generally designated 18, of sufficient length to pass completely through and out of the water level or water trap 20 within toilet bowl 14 so that by manually forcing the tube or conduit 18 through the water trapped within the toilet bowl 14, a soil-stack communicating end 22 of the tube 18 is disposed in gaseous fluid communication with the soil-stack 12, and a user end 24 of the tube 18 is disposed above the water level 20 within the toilet 14. In this manner, the oxygen from the soil-stack 12 is placed in fluid communication with the room in which the toilet bowl 14 is operatively disposed. While this tube or conduit 18, by itself, will enable some of the air from the soil-stack 12 to flow into the bathroom where the toilet bowl 14 is operatively disposed to achieve the full advantage of the present invention, various embodiments of the apparatus of the present invention, capable of connection to the user end 24 of the tube or conduit 18, are provided so that the respiratory system of the user can exclude smoke and other deleterious atmospheric components; so that a number of people can gain access to the soil-stack oxygen; and to increase the amount of soil-stack oxygen that can be caused to flow from the soil-stack 12 into the bathroom.

In accordance with an important feature of the present invention, the apparatus disclosed herein for gaining access to the air from the soil-stack 12, can be operatively connected in fluid communication with the soil-stack 12 without any modification or removal of plumbing fixtures, by taking advantage of the water trap 20 within the toilet bowl 14.

Turning more particularly to FIG. 3, this embodiment of the apparatus of the present invention includes a bellows, generally designated 26 operatively connected at the user end 24 of the tube or conduit 18 and can be manually and reciprocatably operated to pump air from the soil-stack 12 into the area where the toilet bowl 14 is operatively disposed. As best shown in FIGS. 4–6, the bellows 26 includes a rigid, upper manifold plate 28; a lower, toilet bowl-contacting, rigid base plate 30 spaced from the manifold plate 28; a flexible sheet of gas impervious material 32 sealed at its upper edge 34 to the manifold plate 28 and sealed at its lower edge 36 to the base plate 30 to provide a flexible sealed housing for passage of soil-stack gases, particularly air, for pumping the air from the soil-stack 12 into the bathroom area thereby aiding to pressurize the bathroom. Further, the inner periphery of the doorway leading into the bathroom can be partially sealed to further limit the ingress of gaseous contaminants through the doorway and to permit more effective pressurization of said room. For example, the doorway can be partially sealed by adhesively attaching a strip of sheet material around the inner periphery of the doorway. An interior coil spring 38 is operatively connected between a lower surface 40 of the upper manifold plate 28 and an upper surface 42 of the base plate 30 to spring bias the bellows 26 in a normally expanded position, as shown in FIGS. 4 and 5. When the manifold plate 28 is manually compressed toward the base plate 30 against the spring bias of the coil spring 38 and then manually released, the manifold plate 28 will spring back to its expanded position, spaced from base plate 30, while drawing or pumping air from the soil-stack 12 into the bellows 26 for respiration by a user of the apparatus 10. Further reciprocating movement of the manifold plate 28 will cause the air in the bellows 26 to be pumped out of the bellows into the bathroom area as will be described in more detail hereinafter.

As best shown in FIGS. 3–6, the manifold plate 28 of bellows 26 includes a plurality of air outlet ports 44 each sealed with a threaded cap 46. As best shown in FIG. 4, a check valve generally designated 48, is operatively connected to the lower surface 40 of the upper manifold plate 28 so that operation of the bellows 26 by compression of the upper manifold plate 28 toward the lower base plate 30 will cause soil-stack air to flow upwardly past ball 50 around its valve seat 52 for passage through the air outlet ports 44 to the respiratory system of one or more users. After the upper manifold plate 28 is allowed to return to its expanded position, the ball 50 will seal within the valve seat 52 so that further compression of the upper manifold plates of bellows 26 toward the base plate 30 will force air upwardly out of the bellows 26 from the soil-stack 12 through the outlet ports 44 instead of filling the bellows from the outlet ports 44. It is to be understood that one or more check valves 48 can be positioned anywhere within the fluid communication between the user end of the apparatus and the soil-stack communicating end 22 of the access tube or conduit 18 or may be included in a breathing mask, such as that shown in FIG. 5.

In the preferred embodiment shown in FIG. 6, the bellows 26 includes retaining straps 54 to maintain the bellows 26 in a compressed condition for storage. The retaining straps 54 secure the upper manifold plate 28 of bellows 26 in a compressed position closely spaced from the lower base plate 30 by passing through apertures 56 in the upper manifold plate 28 and through aligned apertures 58 in the base plate 30 to hold the bellows in a compressed or storage position. As best shown in FIG. 6, the lower base plate 30 includes a removable filter housing, generally designated 60, capable of retaining a removable filter material 61, such as charcoal or the like, for removal of organic materials, and other deleterious gases, from the soil-stack gases.

As best shown in FIGS. 4 and 5, and in accordance with an important feature of this embodiment of the present invention, the bellows 26 is secured to the toilet bowl 14 at a bellows retaining plate, generally designated 62, disposed against an undersurface 64 of an upper, surrounding flange or upper lip portion 66 of the toilet bowl 14.

As best shown in FIGS. 4 and 5, the bellows retaining plate 62 is longer than it is wide in a somewhat rectangular shape but having rounded corners (or oval shape) so that the farthest spaced, opposite edges 68 and 70 can be manually maneuvered to be disposed beneath the undersurface 64 of toilet bowl lip 66 of toilet bowl 14. To operatively connect the apparatus 10 to the soil-stack 12, an upper surface 72 of bellows retaining plate 62 is disposed in contact with the undersurface 64 of lip 66 of the toilet bowl 14 immediately above the farthest spaced opposite edges 66 and 68 of the bellows retaining plate 62. The bellows retaining plate 62 then is secured to the bellows 26, sandwiching the lip 66 of the toilet bowl 14 between the bellows retaining plate 62 and the base plate 30 of the bellows 26 to secure the bellows 26 in position resting on an upper surface 74 of the toilet lip 66 for manual bellows operation.

As best shown in FIGS. 4 and 5, the bellows retaining plate 62 includes an annular, upwardly extending nipple portion 76 for threaded engagement with a complementary threaded female boss 78 downwardly extending from the base plate 30 of the bellows 26 for securing the bellows retaining plate 62 to the bellows 26 while providing a central air passage for fluid communication between the soil-stack 12 and the bellows 26. The nipple portion 76 extending upwardly from the bellows retaining plate 62 includes a check valve, generally designated 80, including a ball 82 adapted to seat and seal within a valve seat 84. An annular boss 86 extends downwardly from a lower surface 88 of the bellows retaining plate 62 and integral with the retaining plate 62 to provide an annular outer surface for frictionally securing the tube or conduit 18 to an outer surface of the boss 86. Hose clamp 90 can be secured around the outer periphery of the tube 18 to assure sealed connection between the inner surface of tube 18 and the outer surface of boss 86. As shown in FIG. 4, a rigid bar 92 traverses the nipple portion 76 above the check valve ball 82 as a stop member to prevent the ball 82 from damaging the charcoal filter material 61 or entering the bellows 26 when the bellows 26 is expanding to cause air to flow through the bellows 26 and into the bathroom.

As shown in FIG. 7, the retaining straps 54 can be disengaged from the base plate 30 along one side of the base plate while kept in place along another side of the base plate 30 so that the bellows 26 can be manually operated by pulling downwardly on the released retaining straps 54 along one side of the bellows 26 or otherwise compressing the upper manifold plate 28 with hand or foot along the side of the released straps 54 to force soil-stack air outwardly from the outlet ports 44 into the bathroom.

In accordance with another important embodiment of the present invention, as shown in FIG. 5, a breathing mask, generally designated 94, is provided capable of being secured over the face of the user of the apparatus of the present invention and includes typical inhalation and exhalation valves (not shown) so that air can be inhaled through a flexible, annular connecting tube or conduit 96 but cannot be exhaled back through the connection tube 96 but is exhaled to the surrounding atmosphere, e.g., the bathroom thereby aiding to also pressurize the bathroom to a pressure higher than surrounding living areas. The connecting tube 96 of mask 94 includes an adapter 98 attached at a free end 99 of the connecting tube 96 and capable of being frictionally sealed or threadedly connected to the air outlet ports 44 extending from the upper manifold plate 28 of the bellows 26. A number of breathing masks or air masks 94 can be provided for attachment to any or all of the air outlet ports 44 to provide soil-stack air directly to the respiratory system of all those wearing the breathing masks 94.

In accordance with another important embodiment of the present invention, a simpler, portable apparatus can be provided for travelers including a smaller diameter, flexible soil-stack access tube or conduit 18A; a tubular filter housing 100 containing a suitable filter material, such as charcoal 102 and an air outlet port manifold tube 104 or 106 having any desired number of air outlet ports 44A or 44B, respectively, sealed with threaded caps 46A or 46B, respectively. A tubular check valve connector 107, such as that shown in FIG. 10, is frictionally sealed at one annular end to a user end 24A of the conduit 18A, and a free annular end 108 of the check valve connection 107 is shaped to be received in a frictionally engaging, sealed connection to an interior diameter of an integral, downwardly extending boss 110 integral with the portable filter housing 100, for connecting the filter housing 100 to the flexible tube 18A. Similarly, the portable filter housing 100 includes an upwardly extending, annular boss 112 integral with the portable filter housing 100 and adapted to be frictionally fit and received within an interior diameter of the air outlet port manifold tube 104 or 106 so that the soil-stack air pass through the filter material 102 before being distributed through the air outlet ports 44A or 44B. Breathing can be accomplished directly from the air outlet ports 44A or 44B where one or more breathing masks can be attached to the air outlet ports 44A or 44B, as described with respect to the embodiments of FIGS. 1–6.

In accordance with another important embodiment of the present invention, as shown in FIG. 9, a larger diameter flexible soil-stack access tube **18*b*, for example, a two inch outside diameter flexible tube, is connected to filter housing 114 containing a suitable filter material, such as charcoal filter material 116 and the filter housing 114 is frictionally connected to a round, hollow, manifold ball 118 containing a plurality of spaced, outwardly extending, sealed nipples 120 integral with the manifold ball 118. The manifold ball 118 is connected to the filter housing 114 by friction fitting an upwardly extending annular boss 122, integral with the filter housing 114, within an internal diameter of an annular boss 124 integral with and extending downwardly from the manifold ball 118. As described with reference to the apparatus embodiment of FIG.8, a tubular check valve connector 107A is sealed by frictional engagement between a user end 24B of the flexible conduit 18B and an annular boss 125 integral with and extending downwardly from the filter housing 114. Each of the outwardly extending nipples 120 integral with the manifold ball 118 includes a threaded sealing cap 126**.

As shown in FIG. 11, in accordance with another important embodiment of the present invention, an annular adapter 128 is provided for frictional or threaded connection at an adapter lower end 130 to one of the air outlet ports 44 upwardly extending from the upper manifold plate 28. An upper annular edge 132 of the adapter 128 is shaped for sealing engagement with a vacuum cleaner tube 134. In this manner, if the electricity is operative within the bathroom area, a vacuum cleaner 136 can be attached to one of the air outlet ports 44 through the adapter 128 for electrically pumping air from the soil-stack 12 into the bathroom area.

In accordance with another important embodiment of the present invention, an upper end of the soil-stack 12 is provided with an air-receiving upper elbow device, generally designated 140, attached to an upper annular end 142 of the soil-stack 12 above the building roof 16. The elbow 140 is attached at the upper free end 142 of the soil-stack 12 at a bearing assembly 144, containing a plurality of round metal bearings 146 to enable the elbow device 140 to rotate a full 360° so that the elbow 140 can always be disposed to face in the direction of the wind to receive the maximum amount of oxygen from the prevailing atmospheric conditions. The elbow 140 includes an integral, upwardly extending exterior aligning plate device, generally designated 148, shaped so that the elbow device 140 automatically will rotate due to the atmospheric wind contacting the device 148 to align the elbow 140 in the direction of the wind for maximum oxygen intake in the soil-stack 12.

The elbow aligning device 148 is weighted more heavily along a rear surface 156 to aid in maintaining an annular air inlet 158 in a direction facing the wind. Further, the aligning device 148 is formed from an upper V-shaped panel 160, having legs of the V, 162 and 164, curved upwardly and outwardly and forming integral connections with a pair of side panels 166 and 168, wider near the air inlet 158 than at an upper portion of the V-shaped panel 160. This shape will create equal wind forces on side panels 166 and 168 to maintain the aligning device 148, and therefore the elbow 140, in alignment with the wind.

An interior baffle plate 150 (FIG. 12) is provided on the interior of the elbow device 140 and is capable of being manually rotated, or rotated automatically by the wind, as an air inlet valve, to a fully open (FIGS. 12 and 14) or a closed (FIG. 15) position to allow a predetermined percentage of the atmospheric air to pass downwardly through the elbow device 140 into the soil-stack 12. The baffle plate 150 includes cut out portions 152 and 154 in its periphery so that even in the fully closed position, adequate air is received by the soil-stack 12.

The baffle plate 150 is operatively connected to a pivotable axis 170 having integrally connected thereto, a wind-rotatable exterior baffle plate 172 disposed on the exterior of the elbow 140 and in alignment with the interior baffle plate 150. Strong winds, e.g., 20 m.p.h., hitting the exterior baffle plate 172 will cause the interior baffle plate 150 to rotate to a partially closed position (FIG. 15) to control the intake of air into the soil stack 12 so as not to disrupt the integrity of the toilet bowl water traps by too much air entering the soil stack 12 as a sudden in-rush. The interior baffle plate 150 will return to its fully open position, as shown in FIG. 14 when the wind lessens because of the increased weight of the baffle plate 150 along a lower end 174, due to its larger size relative to an upper end 176.

I claim:

1. In combination with an apparatus for establishing fluid communication between a room containing a toilet bowl in fluid communication with a building soil stack and gases within the soil stack wherein a flexible conduit having a sufficient length and diameter is capable of being manually forced completely through and out of a water trap within a toilet bowl, so that a first end of the flexible conduit is disposed on a soil stack side of the water trap and a second end of the flexible conduit is disposed on a toilet bowl side of the water trap in fluid communication with the building soil stack;

the improvement comprising mechanical pump means operatively connected to the second end of the flexible conduit; said pump means providing means for pumping soil stack gases from said soil stack, through said flexible conduit; into the room; pressurizing the room to a presure above that of the surrounding areas; and limiting the ingress of gases from the surrounding areas; said pumping means providing enough soil stack gas in the room to simultaneously accommodate the breathing needs of a plurality of users.

2. The apparatus of claim 1 wherein the gas flow means comprises a bellows operatively connected to said second end of the flexible conduit, and wherein the bellows is operated by manually compressing the bellows repeatedly to force soil stack gases into the room and repeatedly expanding the bellows to allow more soil stack gases to flow into the bellows.

3. The apparatus of claim 1 wherein the gas flow means comprises a household vacuum cleaner operatively attached in fluid communication with the second end of the flexible conduit.

4. The apparatus of claim 1 further including header means operatively connected to the second end of the flexible conduit, said header means including a plurality of sealable access openings for permitting a plurality of people within the room access to the soil stack gases.

5. In apparatus for establishing gaseous communication between a room of a building, wherein said room contains a toilet bowl having a water trap, and a building conduit disposed within the building, said building conduit being in gaseous communication with the atmospheric gases outside of the building and the water trap of the toilet bowl, said apparatus comprising: a toilet bowl having a water level forming a water trap, said toilet bowl having a flexible, water-impermeable, tubular member manually inserted completely through the water trap so that a first end of the flexible tubular member is disposed on a building conduit side of the water trap and a second end of the flexible tubular member is disposed on a room side of the mechanical water trap, the improvement comprising mechanical pump means operatively connected to the second end of the flexible tubular member for pressurizing said room and enabling a user of the apparatus to cause gases within said building conduit to flow from said building conduit through the flexible tubular member into the room to pressurize said room and provide breathing air to said room for breathing purposes within the room.

6. The apparatus of claim 5 wherein the gas flow means comprises a bellows operatively connected to said second end of the flexible conduit, and wherein the bellows is operated by manually compressing the bellows repeatedly to force soil stack gases into the room and repeatedly expanding the bellows to allow more soil stack gases to flow into the bellows.

7. The apparatus of claim 5 wherein the gas flow means comprises a household vacuum cleaner operatively attached in fluid communication with the second end of the flexible conduit.

8. A method of inhaling gases from a building soil stack to lessen inhalation of undesirable atmospheric contaminants within a living area comprising manually inserting a flexible conduit formed of a water-impermeable material completely through a water trap in a toilet bowl establishing fluid communication between a soil stack side of the water trap and a toilet bowl side of the water trap and operating a mechanical pump means for pressurizing said living area and providing breathing gases from the soil stack through said flexible conduit to the toilet bowl side of the water trap, so as to accommodate a plurality of users in need of inhaling said soil stack gases in said room.

9. The method of claim 8 further including the step of operatively connecting a bellows member to an exposed end of the flexible conduit and operating the bellows by manually compressing the bellows repeatedly to force soil stack gases into the room and repeatedly expanding the bellows to allow more soil stack gases to flow into the bellows.

10. The method of claim 8 further including the step of operatively connecting a vacuum device to an exposed end of the flexible conduit and operating the vacuum device to draw soil stack gases through the flexible conduit and into said living area.

11. The method of claim 8 including the step of operatively connecting a header means to an exposed end of the flexible conduit to permit a plurality of people access to the soil stack gases.

12. A method of limiting the ingress of gaseous contaminants into a room containing a toilet bowl in fluid communication with a soil stack, comprising manually inserting a water-impermeable, flexible conduit completely through a water trap in the toilet bowl from a toilet bowl side of the water trap to a soil stack side of the water trap so that a first end of the flexible conduit is disposed on the soil stack side of the water trap and a second end of the flexible conduit is disposed on the toilet bowl side of the water trap;

operatively connecting the second end of the flexible conduit to a pump means, causing soil stack gases to flow through the flexible conduit from the soil stack side of the water trap to the room on the toilet bowl side of the water trap;

operating the mechanical pump means to cause soil stack gases to flow into said room and increase the ambient pressure in said room above that of surrounding living areas and limiting the ingress of gases from outside of said room for breathing purposes of those in said room.

13. The method of claim 12 further including the step of partially sealing an inner periphery of a doorway leading into said room to further limit the ingress of gaseous contaminants through the doorway and to permit more effective pressurization of said room.

14. The method of claim 12 wherein said gas flow means comprises a bellows operatively connected to said second end of the flexible conduit, and wherein the bellows is operated by manually compressing the bellows repeatedly to force soil stack gases into the room and repeatedly expanding the bellows to allow more soil stack gases to flow into the bellows.

15. The method of claim 12 wherein said gas flow means comprises a household vacuum cleaner operatively attached in fluid communication with the second end of the flexible conduit.

16. The method of claim 12 wherein the doorway is partially sealed by adhesively attaching a strip of sheet material around the inner periphery of the doorway.

* * * * *